US005593091A

United States Patent [19]

Harris

[11] Patent Number: 5,593,091

[45] Date of Patent: Jan. 14, 1997

[54] DUAL SOLUTION APPLICATION SYSTEM

[75] Inventor: Robert D. Harris, Logan, Utah

[73] Assignee: Harris Research, Inc., Logan, Utah

[21] Appl. No.: 335,210

[22] Filed: Nov. 7, 1994

[51] Int. Cl.[6] ..... B05B 7/26

[52] U.S. Cl. ..... 239/127; 239/131; 239/304; 239/754

[58] Field of Search ..... 239/754, 130, 239/131, 532, 303, 304, 124, 127; 222/145.06, 146.02, 146; 15/321, 322

[56] References Cited

U.S. PATENT DOCUMENTS

| | | | |
|---|---|---|---|
| 748,971 | 1/1904 | Millspaugh | 239/532 X |
| 1,629,160 | 5/1927 | Heermance | 239/130 |
| 1,722,843 | 7/1929 | Fasul | 239/130 |
| 1,779,036 | 10/1930 | Dutton | 239/754 X |
| 2,044,557 | 6/1936 | Alvord | 239/131 X |
| 5,180,439 | 1/1993 | Allison | 239/310 X |
| 5,282,590 | 2/1994 | Zwick | 239/131 X |

FOREIGN PATENT DOCUMENTS

| | | | |
|---|---|---|---|
| 1256801 | 9/1986 | U.S.S.R. | 239/304 |

*Primary Examiner*—Kevin Weldon
*Attorney, Agent, or Firm*—Thorpe North & Western, L.L.P.

[57] ABSTRACT

A system for the mixing of two or more interacting heated solutions and the simultaneous application of the mixed interacting solutions to a fabric surface. The system is made up of a mobile supply base and an elongate applicator having a valved mixing chamber at the proximal end and a fluid distributing manifold at the distal end. The mobile supply base houses multiple containers, each adapted for holding and heating solutions to a desired temperature. The supply base also contains one or more pumps for the delivery of solutions from each container through interconnecting lines to the valved mixing chamber at the proximal end of the applicator. The applicator is an elongated support structure such as a wand. At the proximal end of the applicator, the valved mixing chamber is configured to receive and meter solutions from the supply base through the interconnecting lines into a mixing chamber maintained at substantially ambient pressure. An outflow line connects the mixing chamber with the distribution manifold. The solutions mix and interact in the mixing chamber and the mixed solutions pass through the outflow line to the distribution manifold at the distal end of the applicator. The system is preferably adapted for the mixing of hot carbonate salt and organic acid solutions resulting in the production of a hot carbonating solution in the mixing chamber and the delivery of the carbonating solution through the distribution manifold onto a fabric surface.

14 Claims, 3 Drawing Sheets

DUAL SOLUTION APPLICATION SYSTEM

BACKGROUND OF THE INVENTION

The present invention relates to a dual solution applicator, and in particular to an applicator for cleaning textiles which brings two or more reactive solutions together momentarily before contacting the textile to be cleaned.

The use of cleaning agents to remove soil, oils and other stains from carpet, upholstery and other textiles is well known. Typically, a composition is mixed from one or more solutions and then applied to the textile by an applicator. Often the compositions include soaps and other detergents which are generically referred to as "surfactants." By "surfactant" is meant a synthetic amphipathic molecule having a large non-polar hydrocarbon end and a polar end which is water soluble. Numerous different types of applicators have been developed for applying various types of surfactant solutions, and for applying the solutions to various types of textiles. However, the vast majority of these applicators apply a single composition. Until relatively recently, the surfactants have been the cleaning agent of choice, despite the fact that surfactants leave an oily residue on the textile that makes the textile more prone to resoiling, and are generally unfriendly to the environment.

Recently, several advances have occurred in the cleaning arts which enable cleaning compositions to reduce, or in some cases all together eliminate, the use of surfactants. For example, in U.S. Pat. No. 4,219,333, a significant improvement in the art of cleaning textile fibers is shown. This patent shows that, when detergent solutions are carbonated and applied to the fibers, the solution quickly penetrates the fibers and lifts away soil and oil by effervescent action. Because of the improved cleaning ability of the carbonated solution, significantly less surfactants need be used to clean the textiles. While such a method required a pressurized container to carbonate the cleaning solution, a traditional applicator applying a single solution could be used.

In U.S. patent application No. 5,244,468, a urea containing internally carbonated non-detergent cleaning composition and method of use are disclosed. The invention improved on that disclosed in U.S. Pat. No. 4,219,333, by providing a composition which avoids the need for a pressurized carbon dioxide tank to carbonate the cleaning composition. Instead, the components of the composition react with one another to internally carbonate the solution. The composition is stored in a pressurized container after mixing to maintain carbonation in the composition. Because a single container holds the cleaning composition, and because the solution is used well after the actual reaction occurred, a single solution applicator could be used.

Recently, however, it has been discovered that the benefits of a carbon dioxide effervescence can be increased by having a two or more solutions undergo a chemically or internally-carbonating reaction while actually on the textile to be cleaned. Furthermore, it has been found that the cleaning ability of an effervescent chemically induced carbonating solution is greatly increased when the solution is heated to between 140° F. and 200° F. While effective, both of these methods of increasing the cleaning ability of the composition have physical restraints which significantly limit the ability to use the improvements with conventional applicators. In order to develop an internally-carbonating composition in which the reaction actually occurs on the textile, the solutions which react to release the carbon dioxide must be mixed either on the textile, or very shortly before application to the textile (typically almost instantaneously but not more than about 10–15 seconds). If a conventional applicator is used, the carbon dioxide producing reaction will occur in the container holding the solution, and very little carbonation will reach the textile unless the container is pressurized.

Additionally, a carbonated solution cannot be heated because heating the composition dramatically decreases the ability of the solution to retain carbon dioxide. In the past, the benefits of high temperature cleaning have been overlooked as a combined method with a carbonated cleaning composition because the benefits of heating were offset by the decreased solubility of the carbon dioxide in the solution.

Recently is was discovered that by mixing a carbonate salt solution and an acid solution on the textile or infintessimally before application allowed the carbonating reaction to occur on the textile. Additionally, the decreased solubility of the carbon dioxide in a heated composition is overcome by having a reaction of solutions occur coincident with application of the carbonating solution to the textile, as carbon dioxide solubility is of little importance in an internally-carbonating composition instantly applied. However, to have an internally-carbonating, heated composition, the carbonate solution and the acid solution must be heated separately, and kept separate until immediately before application to the textile.

While this method of heating the two solutions and then combining them works extremely well, the conventional applicators or systems have no method for heating and maintaining the acid and carbonate solutions separately and then bringing them together coincident with their application to textile fibers. Thus, there is a need for a dual solution applicator system which holds solutions separately, and then mixes the solutions shortly before application to the textile so as to generate the desired carbonating reaction.

While discussed above as a means for holding and heating a carbonate solution and an acid solution, a dual solution applicator could also be used for any other application system requiring the separating of two components until just prior to their use, i.e. in instances where there will occur an exothermic reaction, or for combining immiscible liquids such as a hydrocarbon solvent and an aqueous solution until the appropriate time. By holding certain cleaning solutions separate until application or immediately before application, significant improvements in cleaning may be made while minimizing or optimizing the use of surfactants and other undesirable chemicals.

SUMMARY OF THE INVENTION

It is an object of the present invention to provide a dual solution applicator which houses solutions in separate containers and provides means for their admixing and application.

It is another object of the present invention to provide a dual solution applicator which enables the separate solutions to be heated, admixed and dispensed in a controlled manner.

It is an additional object of the present invention to provide a dual solution applicator which can maintain the heat of the solutions within a desired range.

Yet another object of this invention is to provide an application system wherein a hot carbonating solution can be applied to a textile fabric as a sheet or spray of liquid without the solution coming into contact with non-textile objects such as hard surfaces (e.g., furniture or wood or tile flooring).

It is an additional object of the present invention to provide such an applicator which enables the use of other cleaning agents such as presprays, spotters, stain removers, and the like.

These and other objects and advantages of the present invention are achieved in a dual solution application system comprising integrated supply means and application means. The supply means is mounted on a mobile base and houses container means for holding multiple solutions, means for heating the solutions in each container to a desired temperature and means for delivery of solutions from each container to the application means. The application means comprises a support structure, valve means for receiving solutions from the supply means and metering these solutions to a mixing means, means for directing mixed solutions from the mixing means to an application manifold, manifold means for directing mixed solutions to a textile fiber and, optionally, pressurized container means on said support structure for holding and directing a supplemental solution, to a textile fiber in addition to the mixed solution.

BRIEF DESCRIPTION OF THE DRAWINGS

The above and other objects, features and advantages of the invention will become apparent from a consideration of the following detailed description presented in connection with the accompanying drawings in which.

DETAILED DESCRIPTION

Figure 1:
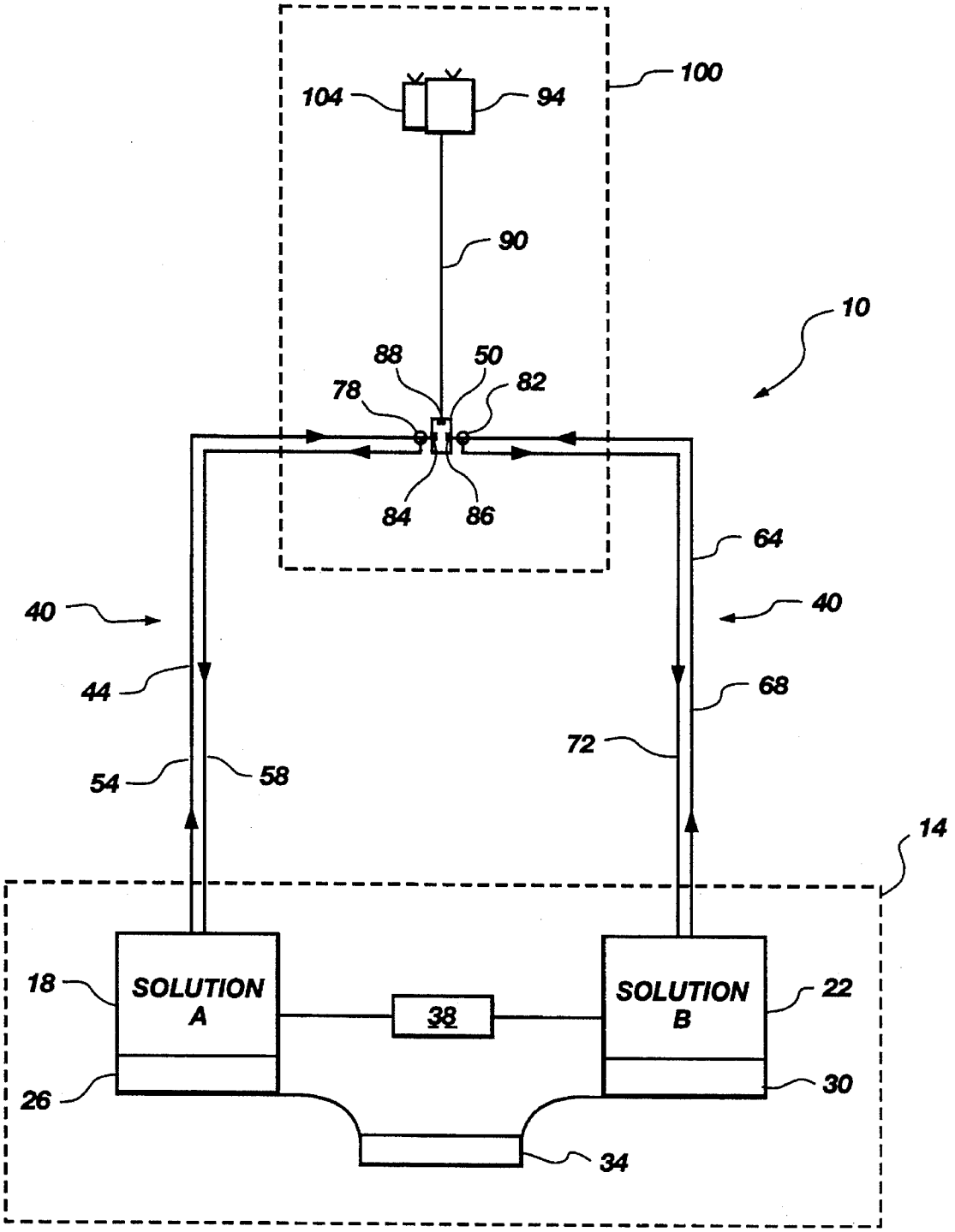
FIG. 1 shows a schematic of a dual solution application system made in accordance with the principles of the present invention.

Reference will now be made to the drawings in which the various elements of the present invention will be given numeral designations and in which the invention will be discussed so as to enable one skilled in the art to make and use the invention. Referring to FIG. 1, there is shown a schematic view of a dual solution application system, generally indicated at 10. The application system 10 will typically include an integrated or interconnected supply means section 14 for heating and holding the solutions to be mixed and an applicator means section 100 for mixing solutions received from the supply means and applying them to textiles in a controlled manner.

In the supply means 14, a first container 18 is provided for holding a solution A, such as a carbonate solution, and a second container 22 is provided for holding a second solution B, such as an acid solution. Typically, the application system 10 will be used when the two solutions, represented by A and B, are reactive, or at least interactive, with one another upon being combined. Each container, 18 and 22, has a heating unit 26, and 30, respectively, for heating the solutions. The heating units 26 and 30 can be either a simple element which heats the containers 18 and 22, and thus the solution, or could be a series of coils which the solution passes through upon exiting the containers. Each of the heating units 26 and 30 is operationally connected to a control panel 34 so that an operator of the application system 10 can adjust the heat applied to each solution in containers 18 and 22 in order to maintain the temperature of the solutions at or within a desired temperature range. Also, at least one pump 38 is provided to pump the solutions out of the containers 18 and 22. Preferentially, the heat applied to each of the containers may be controlled separately. The supply means is preferably mounted on a wheeled base and is encased within a housing having handle means for moving it from place to place (not shown) in order to be mobile.

Interconnecting the supply means 14 and the application means 100 are connecting means 40 consisting of at least two feed lines or hoses 44 and 64. The first feed line 44 leads from the first container 18 to a mixing chamber 50 of applicator means 100. If desired, line 44 may be a biflow line, in that it has an outflow channel 54 through which Solution A moves from the container 18 to the mixing chamber 50, and a recirculating flow channel 58 which circulates Solution A from a point near the mixing chamber back to the container when the application means is not in active use. Likewise, the second feed line 64 may, if desired, include an outflow channel 68 and a recirculating flow channel 72. If biflow lines are used each of lines 44 and 64 will interconnect with valve means 78 and 82 in the application means 100 which, when pump 38 is in operation, provide for recirculation of solutions back to their respective containers until the valves are actuated for introduction of solutions into a mixing means as will next be described.

FIG. 1 shows a schematic of an applicator means 100 which will be described more in detail in FIGS. 2 and 3. Applicator means 100 is portable and has a support structure (not shown in FIG. 1 which is preferably in the form of a wand). At its upper end it contains valve means 78 and 82 which are operationally connected to lines 44 and 64 as described for receiving heated Solutions A and B from containers 18 and 22 respectively. When valve means 78 and 82 are actuated or opened, Solutions A and B will flow into a mixing means or chamber 50 where a chemical reaction, or at least an interaction, begins. When the application system 10 is in use, solution A will be drawn, via valve 78, into the mixing chamber 50 through feed line 44 and solution B will be received through line 64 in like manner. While the solutions will typically be hot when leaving the containers 18 and 22, respectively, they cool as they pass through the lines. The heat loss will depend on a variety of factors such as the diameter and length of lines 44 and 64 and the amount of insulation in the lines. If the applicator is being used intermittently, as is usually the case when cleaning textiles, the solutions in lines 44 and 64 can fall below the desired application temperature. By causing a some or all of the solution to recirculate to the containers 18 and 22, the solution adjacent to the mixing chamber 50 will be kept within the desired temperature range. The exact amount of solution which will need to be diverted through the recirculating flow channels 58 and 72, will depend a variety of factors such a tube diameter, the solution and the material which the feed lines 40 are made of.

Preferentially, the mixing means or chamber 50 will receive solutions from valves 78 and 82 in controlled amounts through small orifices 84 and 86. There is a pressure differential between the pressure of solutions leaving valves 78 and 82 and entering chamber 50 through orifices 84 and 86 which causes turbulence and ensures that the solutions are thoroughly mixed in desired concentrations. The pressure inside the mixing chamber 50 is substantially ambient. When solutions A and B are a carbonate salt and acid solution, the mixed solutions react to create carbon dioxide in a carbonating solution atmosphere. The expansion in volume created by the gaseous carbon dioxide formation causes the carbonating solution to move, at ambient pressure, through an outflow orifice 88 in mixing chamber 50 and along outflow line 90 to a distribution manifold 94 for application of the mixed solution to the textile fabric as will be explained more in detail in conjunction with the description of FIG. 2.

The applicator means 100 can also contain a separate supplemental solution means 104 which the operator may activate to apply a solvent, stain remover, concentrated surfactant, etc. to a stained or very soiled section of the fabric being cleaned before the carbonating solution or other composition is emitted from the manifold 94.

Figure 2:
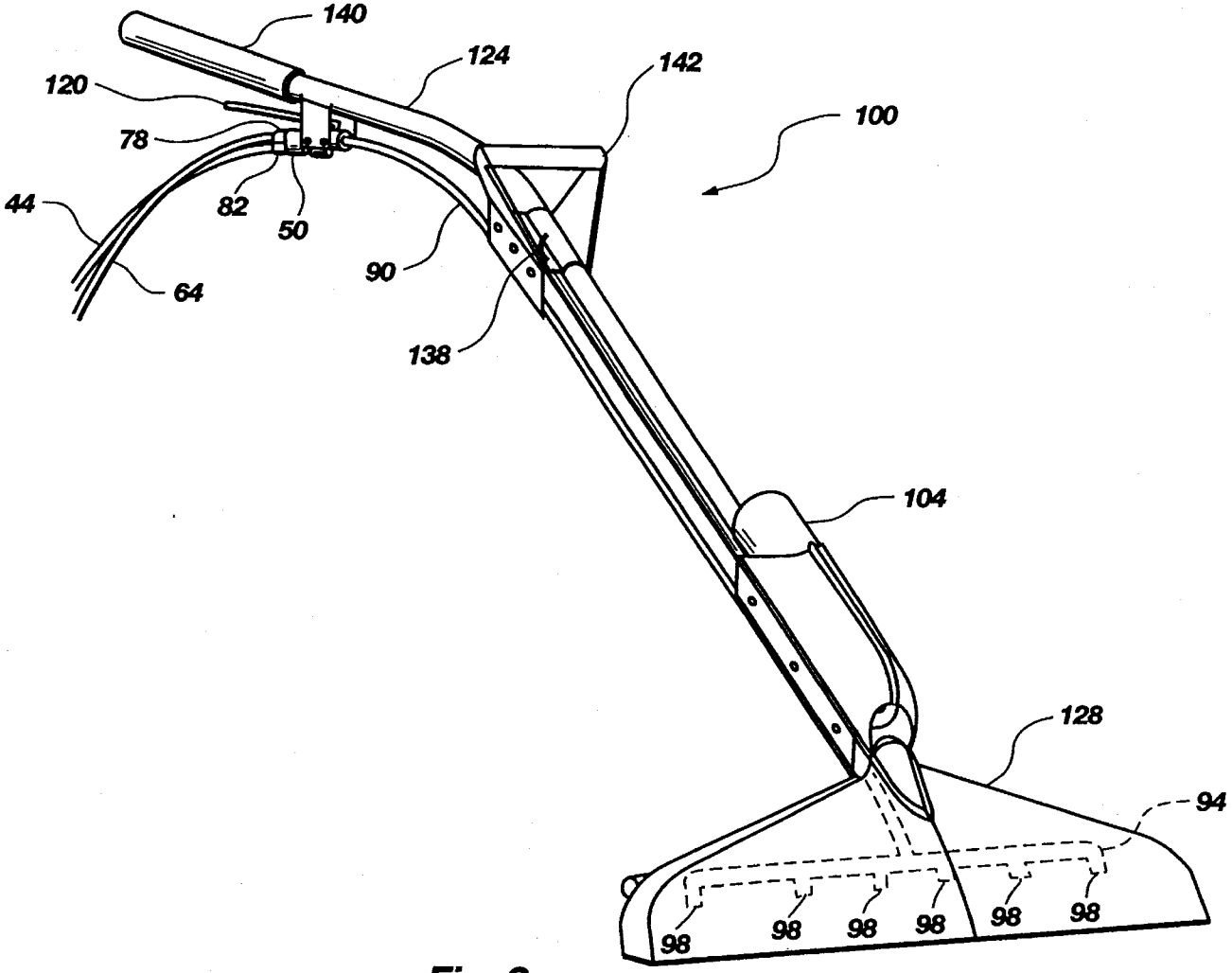
FIG. 2 shows a perspective view of the applicator means portion of a dual solution application system made in accordance with the principles of the present invention.

Referring now to FIG. 2, there is shown a specific embodiment of the applicator 100 schematically diagrammed in FIG. 1. As was discussed, the lines 44 and 64, leading from the supply means section (not shown), connect at valves 78 and 82 to the mixing chamber 50. A lever 120, attached to frame 124, is operatively connected to valves 78 and 82 to actuate and control these valves and thus regulate inflow of solution A and solution B pumped by pump 38 into the mixing chamber 50 from their respective storage tanks 18 and 22. When application of a combined Solution A and B is desired, the lever 120 is pulled, thereby causing the valves 78 and 82 to open and allow flow of the solutions into the mixing chamber 50.

Figure 3:
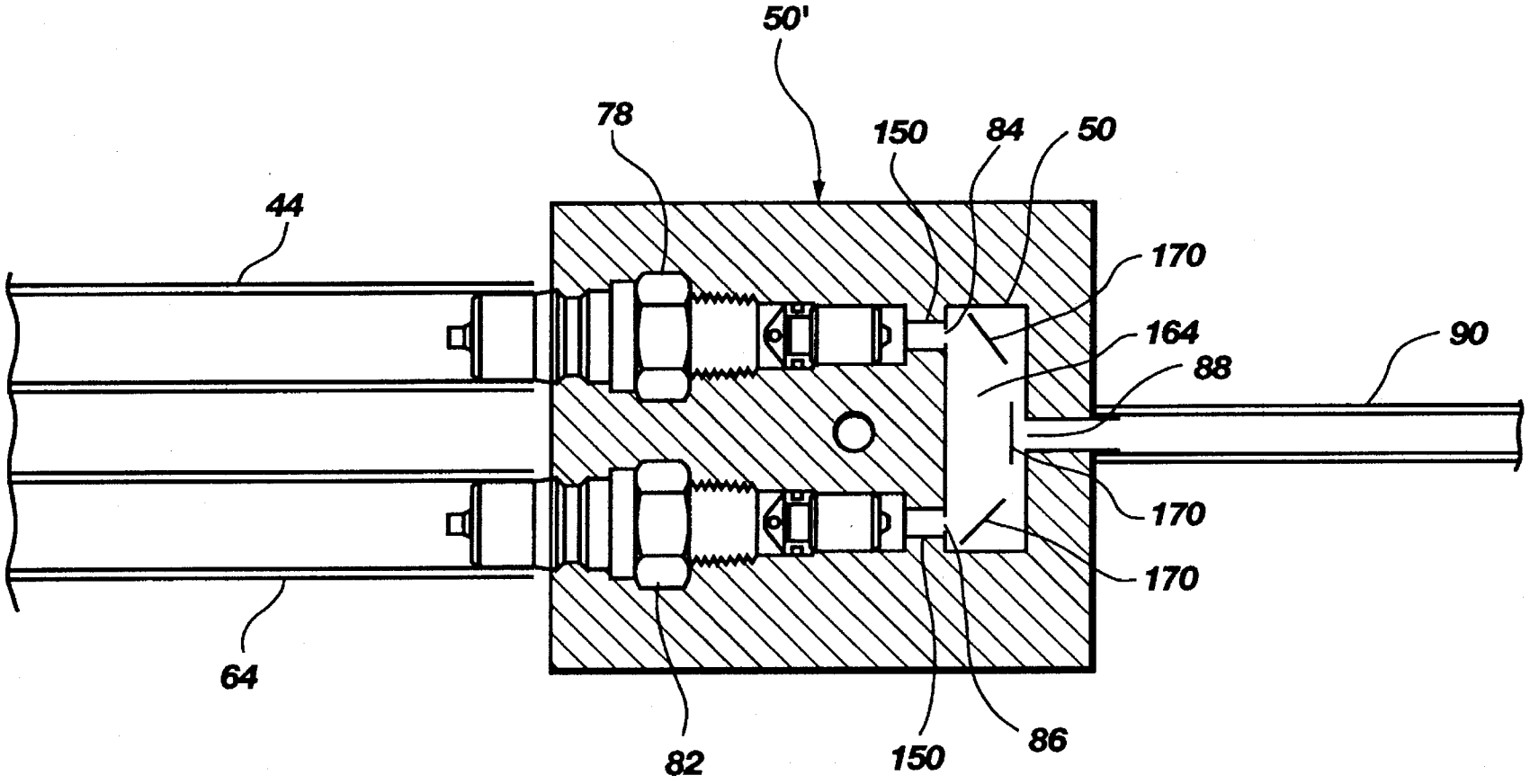
FIG. 3 shows a cross-sectional view of one embodiment of a suitable valve means and mixing means of the application means for combining two or more solutions made in accordance with the principles of the present invention.

Referring now to FIG. 3, there is shown a cross-sectional view of one embodiment of a valve containing mixing means assembly 50' of the applicator means 100. As was discussed earlier, the mixing means assembly 50' consists of a support structure which either houses or interconnects with a pair of pressure check valves 78 and 82. A first valve 78 is connected to feed line 44 which is connected to container 18 (not shown). The second valve 82 is connected to the feed line 64 which is connected to container 22 (not shown). While the actual mechanism is not shown, the valves 78 and 82 are actuated by the lever 120 (FIG. 2) so that both are opened when the lever 120 is pulled toward the frame 124.

The solutions will typically be pumped to the valves 78 and 82 under pressure from pump means 38 as shown in FIG. 1. While the pressure may be regulated by pump means 38, it is anticipated that the solutions in lines 44 and 64 at the valve interface range between about 20 and 60 psig. When the valves 78 and 82 open, the solutions A and B pass through respective valves 78 and 82 and enter a small passage way 150 disposed on an opposite side of the valves. At the end of each passageway 150 is a small orifice 84 and 86, typically about 20 to 100 mils in diameter. Solutions A and B in each passageway 150 will be under essentially the same positive pressure as the solution passing through valves 78 and 82. However, there is a pressure differential between passageway 150 and the interior space 164 of the mixing chamber. As each solution passes through the small orifice 84 and 86 there is an accompanying pressure drop into a mixing chamber space 164, which causes the solutions expand outwardly and fill the chamber. Preferably the solutions will be at a temperature of between about 140° and 200° F. and the mixing of the solutions in chamber space 164 will form a carbonating solution resulting in a chemical reaction with the formation of carbon dioxide. The mixing chamber 164 is kept small so that the mixing solutions do not lose a significant amount of heat due to expansion as they pass out of the small orifices 160 and mix together. The mixed solutions in the mixing chamber are at substantially ambient pressure.

One or more baffles 170 are placed in the mixing chamber 164 to ensure that the two solutions mix sufficiently before leaving the mixing chamber. Once properly mixed, the composition expands due to the reaction and the carbonating solution and carbon dioxide are directed through an outlet port 88 in chamber 50' which, in turn, is connected to outflow tube 90 discussed with respect to FIGS. 1 and 2. The composition is directed through outflow line or tube 90 to a distribution manifold 94 as more particularly shown in FIG. 2. from which the carbonating solution and carbon dioxide are applied to a textile surface.

As was discussed with respect to FIG. 3, the mixing chamber 50 of the mixing means assembly 50' will generally have baffles or other suitable means or devices situated therein to ensure that the two solutions mix sufficiently in space 164 before exiting orifice 88 and traveling through the tube 90 to manifold 94 for application. If these were not provided, the individual solutions could be applied sporadically, decreasing the ability to clean, and increasing the potential for damage to the textile. This is especially true if a high pH solution were being applied with a low pH solution, such as an unbuffered carbonate solution and an unbuffered acid solution. If the solutions did not mix properly the textile could be damaged. Furthermore, to prevent one of the reactive solutions from being applied without the other solution, the valves 78 and 82 will preferably contain some type of safety mechanism to prevent one solution from being supplied without the other, such as might happen if one solution runs out.

Once the solutions have been mixed in the mixing means assembly 50' as shown in FIG. 3, the composition is forced through the outflow tube 90 which is supported by a frame 124. Those skilled in the art will recognize numerous frame arrangements which are available and which could be used in harmony with the principles of the present invention. The frame 124 will preferably be contoured outwardly and downwardly (with reference to an horizontal plane) so that the operator can grasp a generally horizontally disposed handle means 140 at the proximal or uppermost end and a handle grip 142 connected to frame 124 on a downward slope somewhere about midway along the frame. Lever 120 is situated just under handle means 140 at the proximal end such that the lever can be pulled upward to activate or open valves 78 and 82. The distribution manifold 94 is contained at the end of line 90 and is supported at the lower or distal end of frame 124. Surrounding the distribution manifold 94 is a shroud 128 which prevents carbonating solution distributed from openings 98 in manifold 94 from contacting an unwanted surface such as wood flooring, furniture, tile or the like. The mixing chamber 164, line 90 and manifold 94 are maintained at essentially ambient pressure. The moving or propelling force of hot carbonating solution and carbon dioxide is that developed by the entry of solutions A and B through orifices 84 and 86, the combining of these solutions forming carbon dioxide. The forming carbon dioxide gases naturally seek an avenue of expansion which is provided by outlet line 90 and distribution manifold 94 which terminates in a series of openings 98 shown in FIG. 2.

The pressure of solutions at the inlet side of orifices 84 and 86, the diameter of these orifices, the temperature of the solutions and concentrations of carbonate salt and acids in the respective solutions, the size of the expansion chamber 164 (FIG. 3), the length and diameter of outlet line 90 and the size of openings 98 in manifold 94 all contribute to the velocity or rate at which the carbonating solution formed in chamber 164 moves through line 90, and out the openings 98 of manifold 94. It is necessary that the temperature be maintained above a minimal temperature, e.g. above 140° F. and that the solution coming from openings 98 be in the form of large droplets of a thin sheet or film of such solution. If the solution coming from openings 98 was in the form of too small droplets or atomized as a fine spray, there could be too great a temperature drop to efficiently take advantage of both hot temperature cleaning and carbonation. The determining of such parameters will be made according to the size of the equipment and operation desired and can be readily determined by one skilled in the art from the description contained herein.

Completing the application means 100 is supplemental solution means 104 on frame 124 for holding an aerosol can and switch means 138 mounted in conjunction with handle means 142. While the specific mechanism is not shown, it is apparent that switch means 138 can be connected by a line or plunger means to an aerosol nozzle at the end of a canister mounted in means 104 such that, pulling or sliding handle 142 backwards along frame 124 can cause the aerosol nozzle to be depressed and some of the contents in the aerosol canister to be sprayed at a point directly in front of shroud 128. These contents can be a prespray of solvent, stain remover, detergent concentrate or any other fluid required or desired from treating excessively soiled or stained fabrics and carpets in particular.

When applying the carbonating solution to a textile surface through openings 98, the manifold 94 will be positioned such that the openings 98 will be between 0.5 and 2 inches from the textile to be cleaned, and will emit large droplet or sheets of the composition. Traditional applicators have atomized the cleaning solution to evenly spread the solution on the textile. However, atomized solution loses heat rapidly and it is difficult to maintain enough heat so that the composition contacting the carpet is in excess of 140° F. Such a minimum temperature is important because the fibers of many modern carpets are designed to return to their original orientation when cleaned with hot solutions. Thus, to transport the composition from the containers 18 and 22 (FIG. 1) to the manifold openings 98 as described, it is important not to waste additional heat due to atomization. To resolve this concern, the openings 98 emit large droplets which wastes substantially less heat than atomizing the solution. The sheet of cleaning composition, because it is a carbonating solution, penetrates the textile just as rapidly and efficiently as if the composition was applied from a pressurized container.

Because the solution is carbonating and the carbonating reaction continues even after application to the fabric, a shroud 128 is usually provided so that the composition does not spray items adjacent to the textile. This is of particular concern in cleaning upholstery and carpet, as chemicals which clean these textiles can sometimes be damaging to other household fixtures.

When a prespray canister, contained in means 104 mounted on the frame 124, is used to pretreat stains before the carbonating solution composition is applied such application is greatly simplified over conventional type of application. When using the applicator 100 of the present invention, the operator need not put the applicator down each time a stain is encountered. As noted above, the means 104 is controlled by a switch 138 mounted in conjunction with or adjacent to a handle 142 and can be activated concurrently with the application of the carbonating solution.

When the applicator system 10 is used with internally carbonating compositions, the two solutions, typically a carbonate solution and an acid solution are directed to the mixing chamber 50 by the lines 44 and 64 respectively. Once in the mixing chamber 50, the two solutions are combined and begin to react. As they do so, carbon dioxide bubbles are formed, causing the composition to expand in volume. The reacting composition is forced through the tube 90 and out the manifold 94 so that it contacts the textile. The time difference from the point of mixing solutions in chamber 50 to application of a hot carbonating solution on the textile will typically take between about 0.5 and 3 seconds. Because the reaction of the carbonate salt and the acid in solution is typically between 0.5 to 15 seconds, the composition is still reacting when it reaches the textile to be cleaned. Thus, effervescent carbon dioxide is applied to the carpet, providing a superior cleaning ability that carbonated solutions using conventional pressurized applicators cannot obtain. The ongoing release of carbon dioxide from the composition using the system described herein overcomes any problems associated with the decrease of carbon dioxide solubility which occurs when heating a precarbonated composition.

After being applied to the textile, whether carpet or upholstery, the composition is allowed to remain on the carpet for a short period of time. The composition, along with oil and soil particulate that have been removed from the fibers of the textile, are then removed by either an absorbent pad or by vacuuming the area.

In summary, a dual solution application system is provided. The system utilizes dual holding containers, feed lines and a mixing chamber to enable reactive solutions to be stored separately, but mixed together immediately prior to application on a textile. It is to be understood that the above-described arrangements are only illustrative of the application of the principles of the present invention. Numerous modifications and alternative arrangements may be devised by those skilled in the art without departing from the spirit and scope of the present invention. The appended claims are intended to cover such modifications and arrangements.

What is claimed is:

1. A solution application system for mixing at least two solutions and applying the mixed solutions to textiles comprising:

supply means on a mobile base said means containing containers for separately holding each solution, means for heating the solution in each container to a desired temperature and means for delivery of solution from each container to a feed means, applicator means comprising a portable elongate support structure having a proximal solution receiving end and a distal solution application end said support frame being contoured from the proximal to distal end outwardly and downwardly and containing an intermediate handle means between said proximal and distal ends, valve means attached to said proximal end containing a valve for each solution to be delivered, each valve having a connector for receiving solution from a container through a feed means and adapted to deliver said solution to a mixing means, mixing means for receiving said solutions from said valve means and causing said solutions to form a mixed solution at essentially ambient pressure, conveying means for directing said mixed solution at essentially ambient pressure from said mixing means to an application manifold means and application manifold means attached to the distal solution application end of said support structure for receiving mixed solution from said conveying means, said manifold means having exit ports to direct said mixed solution to a textile fiber, and feed means interconnecting each container of said supply means to a connector of said valve means of said applicator means for conveying solution from each of said containers of said supply means to said valve means of applicator means.

2. The system of claim 1 wherein the means for delivery of solution from each container to a feed means is a pump.

3. The system of claim 1 wherein said mixing means for receiving solutions from said valve means and causing said solutions to form a mixed solution at essentially ambient pressure, comprises a chamber having an inlet orifice in communication with each valve of said valve means and an outlet orifice in communication with said delivery means.

4. The system of claim 3 wherein said inlet orifices have a diameter sufficiently small that activation of said valve means causes solution flowing through said valve means to enter said mixing means through said inlet orifices with an accompanying pressure drop to form said mixed solution and wherein the outlet orifice is sufficiently large that said mixed solution flows from said mixing means to said delivery means at essentially the same pressure said mixed solution attained in said mixing means.

5. The system of claim 4 wherein said mixing means contains means for promoting the mixture of solutions entering said inlet orifices.

6. The system of claim 3 wherein said manifold means is surrounded by a shroud having an open bottom which shroud is connected to said distal solution application end of said frame such that when the bottom of said shroud is in contact with a surface said exit ports in said manifold will be in close proximity to but will not touch said surface.

7. The system of claim 6 wherein said exit ports will be approximately 0.5 to 2.0 inches above said surface.

8. The system of claim 6 wherein said exit ports are sized such that solution exiting said ports will be as large droplet, or a sheet or film of solution and not an atomized spray.

9. The system of claim 3 wherein said frame further contains lever means at said proximal end operatively connected to said valve means and positioned such that the movement of said lever means toward said frame causes said valve means to be actuated to allow the flow of solution through said valve means to said mixing means.

10. The system of claim 3 wherein said frame further contains means holding a pressurized canister such that said canister is positioned to delivery a pressurized spray to a surface just forward of said shroud when activated.

11. The system of claim 10 wherein said means holding a pressurized canister is supported between said intermediate handle means and said distal end of said frame.

12. The system of claim 11 wherein said intermediate handle means contains means for activating said pressurized canister.

13. The system of claim 3 wherein said feed means comprises outflow and recirculating feed lines interconnecting each container of said supply means with said valve means such that solution from each container is circulated to said valve means and recirculated from said valve means to said container when said valve means is in a closed position.

14. The system of claim 3 for the mixing and applying of two solutions.

* * * * *

UNITED STATES PATENT AND TRADEMARK OFFICE
Certificate

Patent No. 5,593,091

Patented: January 14, 1997

On petition requesting issuance of a certificate for correction of inventorship pursuant to 35 U.S.C. 256, it has been found that the above identified patent, through error and without any deceptive intent, improperly sets forth the inventorship.

Accordingly, it is hereby certified that the correct inventorship of this patent is: Gerhard Gnad, Keltern, DE; Stefan Rau, Karlsbad, DE; Ulrich Vogler, Karlsrube, DE; and Klaus Kubik, Toenisvorst, DE.

Signed and Sealed this First Day of April 2003.

MICHAEL Y. MAR
*Supervisory Patent Examiner*
Art Unit 3752

UNITED STATES PATENT AND TRADEMARK OFFICE
Certificate

Patent No. 5,593,091 Patented: January 14, 1997

On petition requesting issuance of a certificate for correction of inventorship pursuant to 35 U.S.C. 256, it has been found that the above identified patent, through error and without any deceptive intent, improperly sets forth the inventorship.

Accordingly, it is hereby certified that the correct inventorship of this patent is: Robert D. Harris, Logan, UT; and William R. Hachtmann, Oakhurst, CA.

Signed and Sealed this Thirteenth Day of December 2005.

MICHEAL Y. MAR
*Supervisory Patent Examiner*
Art Unit 3752